US008330690B2

(12) United States Patent
Lee

(10) Patent No.: US 8,330,690 B2
(45) **Date of Patent: *Dec. 11, 2012**

(54) GAMMA CONTROL CIRCUIT AND METHOD THEREOF

(75) Inventor: Ji-Hyun Lee, Suwon-si (KR)

(73) Assignee: Samsung Electronics Co., Ltd., Suwon-Si, Gyeonngi-Do (KR)

( * ) Notice: Subject to any disclaimer, the term of this patent is extended or adjusted under 35 U.S.C. 154(b) by 320 days.

This patent is subject to a terminal disclaimer.

(21) Appl. No.: 12/726,446

(22) Filed: Mar. 18, 2010

(65) Prior Publication Data

US 2010/0220119 A1 Sep. 2, 2010

Related U.S. Application Data

(63) Continuation of application No. 11/544,161, filed on Oct. 6, 2006, now Pat. No. 7,696,967.

(30) Foreign Application Priority Data

Dec. 27, 2005 (KR) ..... 10-2005-0130496

(51) Int. Cl.
*G09G 3/36* (2006.01)

(52) U.S. Cl. ..... 345/89; 345/690

(58) Field of Classification Search ..... 345/89, 345/87, 204, 690

See application file for complete search history.

(56) References Cited

U.S. PATENT DOCUMENTS

| | | | |
|---|---|---|---|
| 2002/0186230 | A1 | 12/2002 | Kudo et al. |
| 2004/0056868 | A1 | 3/2004 | Kato |
| 2005/0007393 | A1 | 1/2005 | Akai et al. |
| 2006/0164354 | A1 | 7/2006 | Lee et al. |

FOREIGN PATENT DOCUMENTS

| | | |
|---|---|---|
| CN | 1405745 | 3/2003 |
| JP | 2002-041004 | 2/2002 |
| JP | 2002-366112 | 12/2002 |
| JP | 2004-111262 | 4/2004 |
| KR | 1020020004279 | 1/2002 |

OTHER PUBLICATIONS

Office Action dated Aug. 4, 2010 for application No. 200610168650.2 Issued by the Chinese Patent Office.

*Primary Examiner* — Stephen Sherman
(74) *Attorney, Agent, or Firm* — F. Chau & Associates, LLC

(57) ABSTRACT

A gamma control circuit includes a first gray-scale voltage selection unit that selects and outputs a highest gray-scale voltage and a lowest gray-scale voltage from among a plurality of first voltages present between a first supply voltage and a second supply voltage. A second gray-scale voltage selection unit receives the highest and lowest gray-scale voltages and selects and outputs a first intermediate voltage and a second intermediate voltage between the highest and lowest gray-scale voltages. A third gray-scale voltage selection unit receives the highest and lowest gray-scale voltages and the first and second intermediate voltages and generates a plurality of reference voltages from the received voltages. A gray-scale voltage generation unit receives the highest and lowest gray-scale voltages and the plurality of reference voltages and outputs a plurality of gray-scale voltages.

1 Claim, 6 Drawing Sheets

GAMMA CONTROL CIRCUIT AND METHOD THEREOF

CROSS-REFERENCE TO RELATED PATENT APPLICATION

This application is a Continuation Application of U.S. patent application Ser. No. 11/544,161, filed Oct. 6, 2006 now U.S. Pat. No. 7,696,967, which claims priority to and the benefit of Korean Patent Application No. 2005-0130496 filed on De. 27, 2005, the entire contents of both of which are incorporated by reference herein.

BACKGROUND OF THE INVENTION

1. Technical Field

The present disclosure relates to a gamma control circuit and method thereof, and more particularly, to a gamma control circuit for adjusting a gamma curve by selecting a highest gamma voltage and a lowest gamma voltage from among a plurality of voltages, and a method thereof.

2. Discussion of the Related Art

A display device cannot display a true linear relationship between input image data and an output image and, thus, uses a gamma curve to display an optimum image by compensating for the nonlinear relationship and outputting the compensated image. However, a maximum value, a minimum value, and the slope of a gamma curve for the same image data are different according to the type of the display panel being employed.

For this reason, a gamma control circuit that provides various gamma curves is needed. However, the range of adjusting voltages with the existing gamma control circuit is limited and, thus, the integrated circuit chip size must be increased to make the range broader. Therefore, a gamma control circuit that is small in size but can provide various gamma curves, and a method of implementing same, are needed.

FIG. 1 is a block diagram of some constituent elements of a conventional display driving apparatus 100. Referring to FIG. 1, a decoder 120 of the display driving apparatus 100 receives input data and outputs gamma voltages, or, gray-scale voltages, corresponding to the input data, based on gray-scale voltages from a gamma control circuit 110.

If the input data is 6-bit data, the gamma control circuit 110 provides 64 gray-scale voltages V0 through V63. In this case, even if the same input data is supplied to the decoder 120, when a gray-scale voltage corresponding to the same input data is different, a voltage output from the decoder 120 is not the same. That is, a voltage output from the decoder 120 can be controlled by a gray-scale voltage. Accordingly, the gamma control circuit 110 is needed to control a gray-scale voltage according to the type of a display panel being used.

FIG. 2 is a circuit diagram of a conventional gamma control circuit 200. Referring to FIG. 2, control of the gamma voltages is performed by controlling reference voltages VREF1 through VREF8 corresponding to specific ones of the gray-scale voltages V0 through V63. Also, the gray-scale voltages V0 through V63 are controlled by controlling resistance values of variable resistors 214, 216, 234, and 236 in response to control signals C1 through C4, respectively.

Specifically, if the resistance value of the first variable resistor 214 is adjusted based on the first control signal C1, the first reference voltage VREF1, which is a reference voltage of the highest gray-scale voltage V0, is changed. That is, if a resistance value of the first variable resistor 214 is increased, the first reference voltage VREF1 is reduced, and thus, the highest gray-scale voltage V0 is also reduced. If the resistance value of the first variable resistor 214 is reduced, the first reference voltage VREF1 is increased, and thus, the highest gray-scale voltage V0 is increased.

Similarly, if the resistance value of the second variable resistor 216 is reduced in response to the second control signal C2, the eighth reference voltage VREF8 of the lowest gray-scale voltage V63 is reduced, and thus, the lowest gray-scale voltage V63 is reduced. If the resistance value of the second variable resistor 216 is increased, the eighth reference voltage VREF8 is increased, and thus, the lowest gray-scale voltage V63 is also increased. The shape of the whole gamma curve is determined by controlling the resistance of the third variable resistor 234 based on the third control signal C3 and the resistance value of the fourth variable resistor 236 based on the fourth control signal C4.

The first resistor array 252 connects the first and third variable resistors 214 and 234 to generate a plurality of voltages to be used as the second reference voltage VREF2, and one of the generated voltages is selected as the second reference voltage VREF2 in response to a first reference voltage control signal Q1 fed to a voltage selector 258.

The second resistor array 254 connects the third and fourth variable resistors 234 and 236 to generate a plurality of voltages, and a voltage selector selects and outputs the third through sixth reference voltages VREF3 through VREF6 in response to second through fifth reference voltage control signals Q2 through Q5, respectively, fed to the voltage selector 258.

The third resistor array 256 connects the second and fourth variable resistors 216 and 236 to generate a plurality of voltages, and the voltage selector outputs the seventh reference voltage VREF7 in response to a sixth reference voltage control signal Q6, fed to the voltage selector 258. For voltage stabilization, the reference voltages VREF1 through VREV8 are output via corresponding voltage followers, respectively.

The fourth resistor array 270 receives the second through seventh reference voltages VREF2 through VREF7, and outputs the gray-scale voltages V1 through V62, except for the highest and lowest gray-scale voltages V0 and V63.

FIG. 3 illustrates examples 300 of gamma curves that are controlled in response to first through fourth control signals C1 through C4, respectively. Referring to FIGS. 2 and 3, if the resistance value of the first variable resistor 214 is changed in response to the first control signal C1, the first reference voltage VREF1 and the highest gray-scale voltage V0 are changed, thus changing the inclination or slope of the gamma curve. If the resistance value of the second variable resistor 216 is changed in response to the second control signal C2, the lowest gray-scale voltage V63 is changed, thus changing the inclination of the whole gamma curve as illustrated in FIG. 3. If the resistance values of the third and fourth variable resistors 234 and 236 are changed in response to the third and fourth control signal C3 and C4, the highest and lowest gray-scale voltages V0 and V63 are not significantly changed but the intermediate reference voltages VREF2 through VREF7 are changed to change gray-scale voltages, thereby changing the inclination of the whole gamma curve as illustrated in FIG. 3.

FIG. 4 is a circuit diagram of a variable resistor 400 such as that employed in the circuit shown in FIG. 2. Referring to FIG. 4, the variable resistor 400 includes an array of resistors R1 through R4 and analog switches ASW1 through ASWn. The variable resistor 400 controls the overall resistance value by adjusting the number of resistors to be connected by switching on/off the analog switches ASW1 through ASWn in response to a control signals C1 through C4.

The range of adjusting voltages in response to the control signals C1 through C4 and reference voltage control signals Q1 through Q6 must be broad enough to provide various gray-scale voltages. Thus, the number of resistors of the variable resistor 400 and the number of analog switches must be increased to broaden the range, and the switch size must be very significantly increased to reduce resistance values of the analog switches. Also, if the resistance value of the first variable resistor 214 is changed, the whole resistance value is changed and, therefore, all of the reference voltages VREF1 through VREF8 are changed, thereby causing a user's inconvenience when performing gamma control.

As described above, a conventional gamma control circuit that uses variable resistors has a large chip size and is inconvenient to use when performing gamma control. Therefore, there is a need to develop a gamma control circuit that is small sized but can easily perform gamma control, while increasing the range of controlling gray-scale voltages, and a method performing gamma control.

SUMMARY OF THE INVENTION

Exemplary embodiments of the present invention provide a gamma control circuit that is small sized but can easily control gray-scale voltages, while increasing the range of control for the gray-scale voltages.

Exemplary embodiments of the present invention also provide a gamma control method for easily controlling gray-scale voltages while increasing the range of voltage adjustment.

According to an exemplary embodiment of the present invention, there is provided a gamma control circuit that has a small chip size but can easily control gray-scale voltages by selecting a highest gray-scale voltage and a lowest gray-scale voltage, the gamma control circuit including a first gray-scale voltage selection unit, a second gray-scale voltage selection unit, a third gray-scale voltage selection unit, and a gray-scale voltage generation unit.

The first gray-scale voltage selection unit selects and outputs a highest gray-scale voltage and a lowest gray-scale voltage from among a plurality of first voltages between a first supply voltage and a second supply voltage. The second gray-scale voltage selection unit receives the highest and lowest gray-scale voltages, and selects and outputs a first intermediate voltage and a second intermediate voltage from among a plurality of voltages between the highest and lowest gray-scale voltages.

The third gray-scale voltage selection unit receives the highest and lowest gray-scale voltage and the first and second intermediate voltages, and generates a plurality of reference voltages from the received voltages. The gray-scale voltage generation unit receives the highest and lowest gray-scale voltages and the reference voltages, and outputs a plurality of gray-scale voltages from the received voltages.

According to an exemplary embodiment of the present invention, there is provided a gamma control circuit including a first resistor array, a first voltage selector, a second voltage selector, a first voltage follower, a second voltage follower, a second resistor array, a third voltage selector, a fourth voltage selector, a third voltage follower, a fourth voltage follower, a third resistor array, a plurality of voltage selectors, a plurality of voltage followers, and a fourth resistor array.

The first resistor array is connected between a first supply voltage and a second supply voltage to generate a plurality of voltages. The first voltage selector selects one from among the generated plurality of voltages in response to a first control signal. The second voltage selector selects one from among the generated plurality of voltages in response to a second control signal. The first voltage follower receives the voltage selected by the first voltage selector and outputs the received voltage as a highest gray-scale voltage. The second voltage follower receives the voltage selected by the second voltage selector and outputs the received voltage as a lowest gray-scale voltage.

The second resistor array is connected between the highest and lowest gray-scale voltages to generate a plurality of first intermediate voltages. The third voltage selector selects one from among the plurality of first intermediate voltages in response to a third control signal. The fourth voltage selector selects one from among the plurality of first intermediate voltages in response to a fourth control signal. The third voltage follower receives the voltage selected by the third voltage selector and outputs the received voltage as a first intermediate voltage. The fourth voltage follower receives the voltage selected by the fourth voltage selector and outputs the received voltage as a second intermediate voltage.

The third resistor array receives the highest gray-scale voltage, the first intermediate voltage, the second intermediate voltage, and the lowest gray-scale voltage, and generates a plurality of second intermediate voltages from the received voltages. The plurality of voltage selector selects a plurality of reference voltages from among the plurality of second intermediate voltages, respectively. The plurality of the voltage followers receives the reference voltages and outputs a plurality of stabilized reference voltages, respectively.

The fourth resistor array receives the highest gray-scale voltage, the stabilized reference voltages, and the lowest gray-scale voltage, and generates gray-scale voltages from the received voltages.

According to an exemplary embodiment of the present invention, there is provided a gamma control method of controlling gray-scale voltages by selecting the gray-scale voltages from among a plurality of voltages.

The gamma control method includes selecting a highest gray-scale voltage and a lowest gray-scale voltage from among a plurality of first voltages between a first supply voltage and a second supply voltage; selecting a first intermediate voltage and a second intermediate voltage from among a plurality of second voltages between the highest and lowest gray-scale voltages; selecting reference voltages from a plurality of voltages between the highest gray-scale voltage and the first intermediate voltage, between the first intermediate voltage and the second intermediate voltage, and between the second intermediate voltage and the lowest intermediate voltage; and generating gray-scale voltages from the highest gray-scale voltage, the reference voltages, and the lowest gray-scale voltage.

The selecting of the highest and lowest gray-scale voltages comprises generating the first voltages by connecting the first and second supply voltages via a resistor array; selecting the highest gray-scale voltage from among the first voltages in response to a first control signal; and selecting the lowest gray-scale voltage from among the first voltages in response to a second control signal.

The selecting of the first and second intermediate voltages comprises generating the second voltages by connecting the highest and lowest gray-scale voltages via a resistor array; selecting the first intermediate voltage from among the second voltages in response to a third control signal; and selecting the second intermediate voltage from among the second voltages in response to a fourth control signal.

BRIEF DESCRIPTION OF THE DRAWINGS

Exemplary embodiments of the present invention can be understood in more detail from the following descriptions taken in conjunction with the attached drawings in which.

DETAILED DESCRIPTION OF EXEMPLARY EMBODIMENTS

Figure 1:
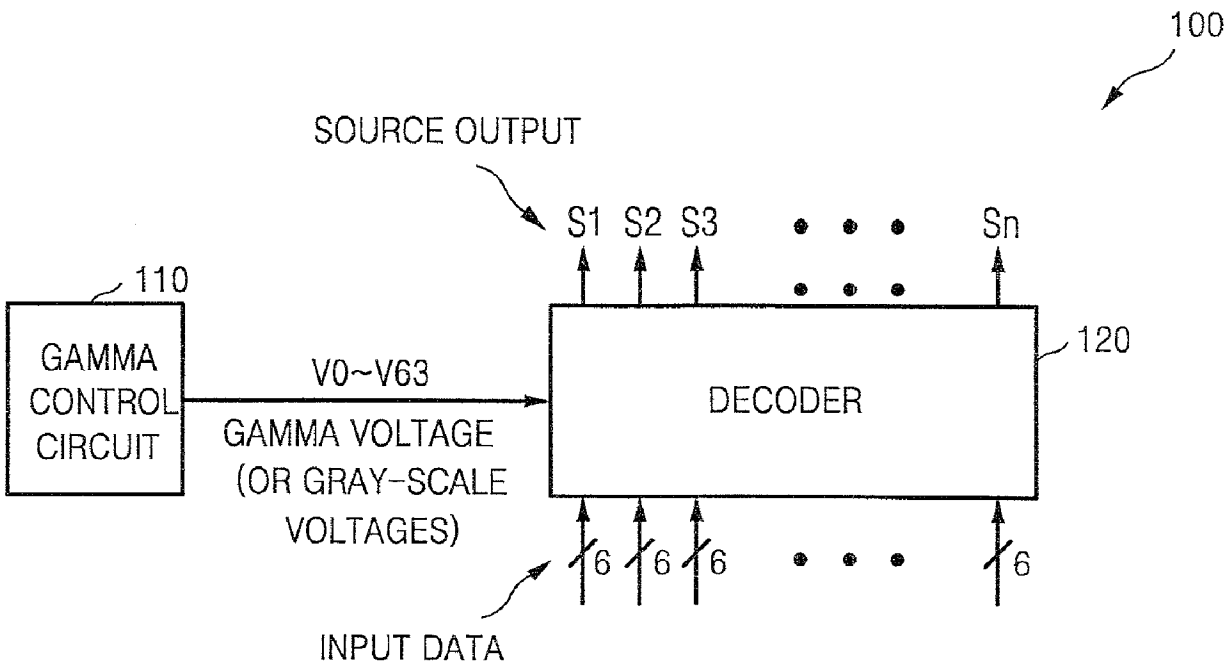
FIG 1 (PRIOR ART)
FIG. 1 is a block diagram of some constituent elements of a conventional display driving apparatus.
Figure 2:
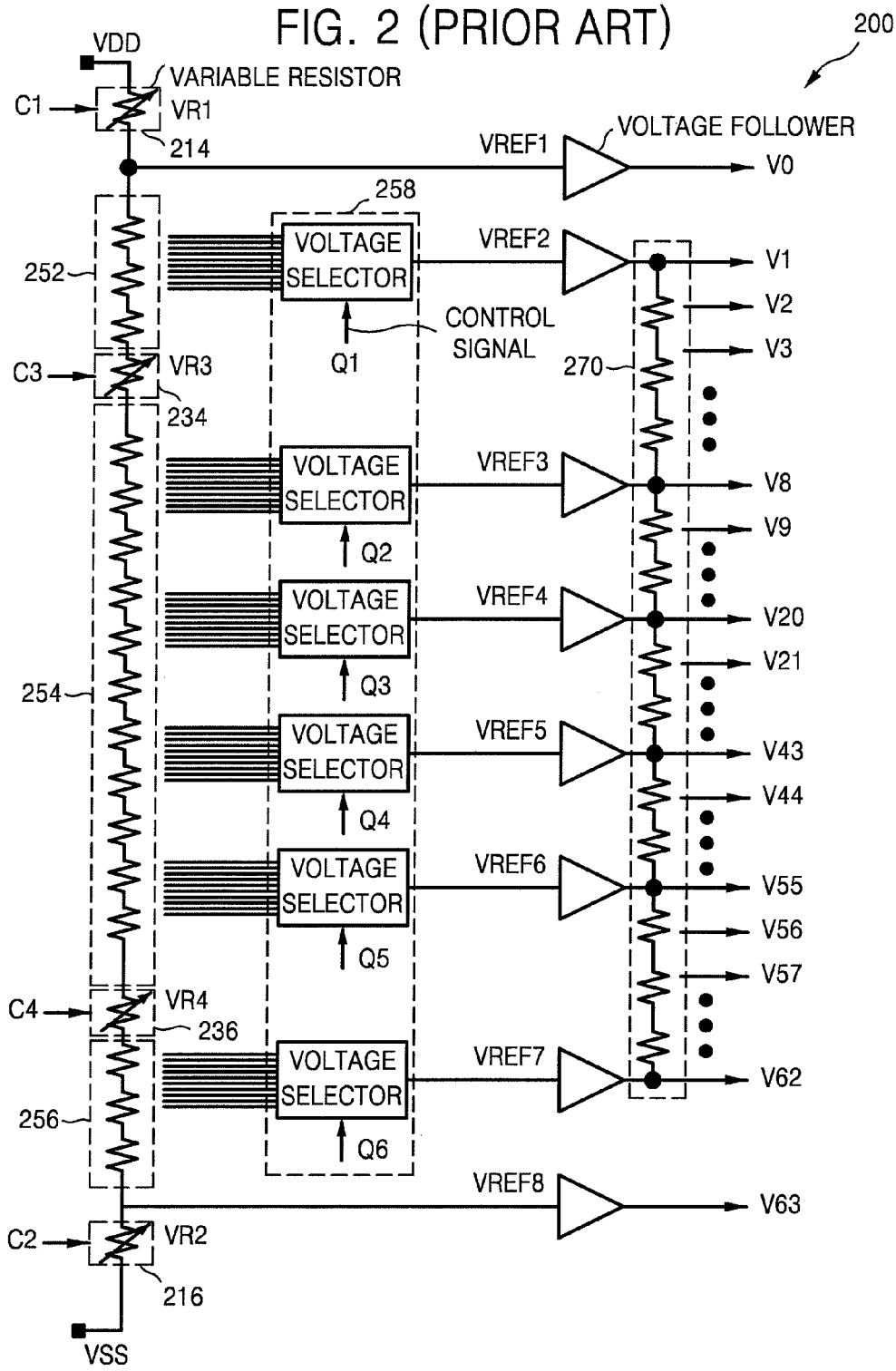
FIG. 2 (PRIOR ART)
FIG. 2 is a circuit diagram of a conventional gamma control circuit.

Hereinafter, exemplary embodiments of the present invention will be described in detail with reference to the accompanying drawings. Like reference numerals denote like elements throughout the drawings.

Figure 5:
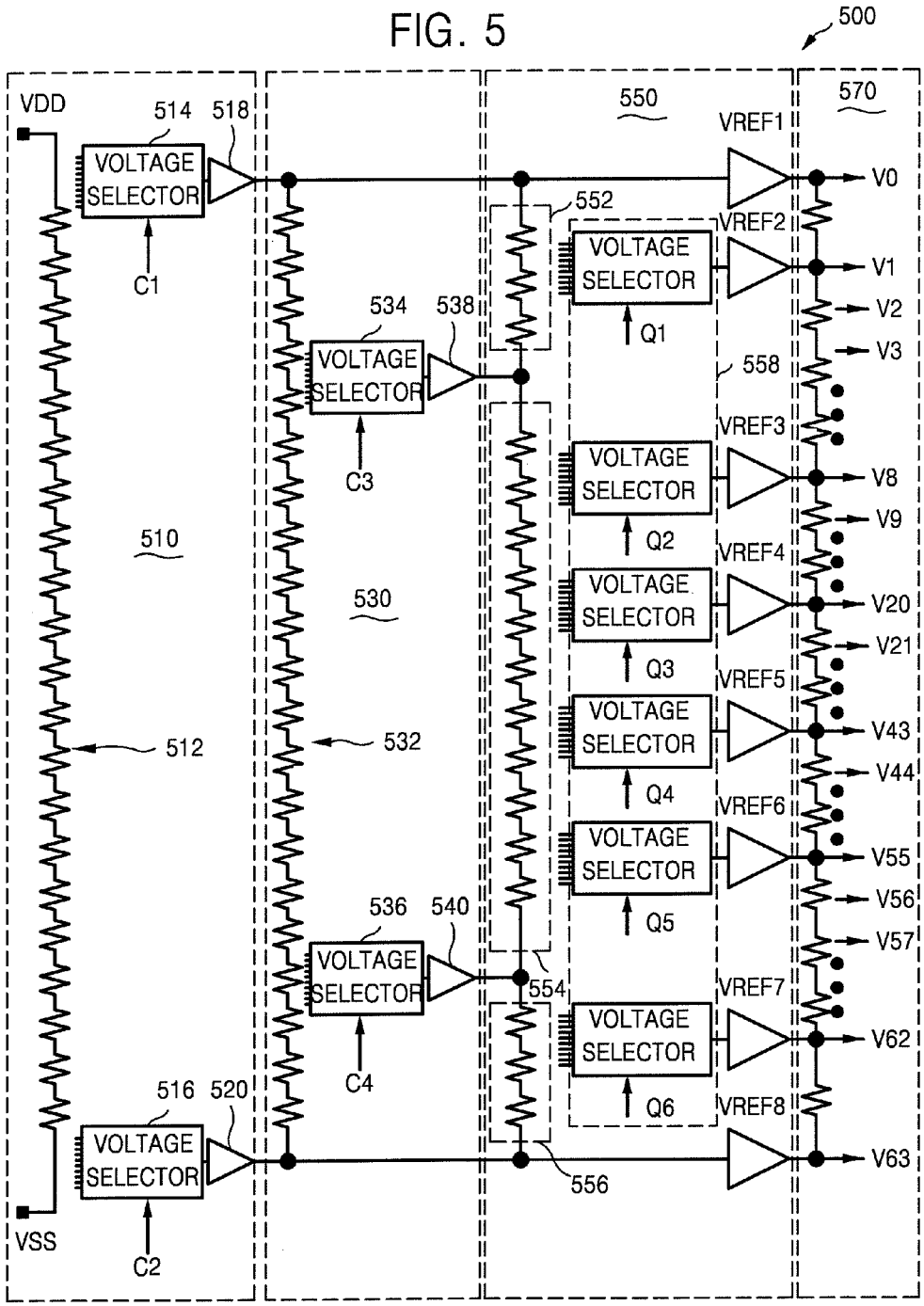
FIG. 5 is a circuit diagram of a gamma control circuit according to an exemplary embodiment of the present invention.

FIG. 5 is a circuit diagram of a gamma control circuit 500 according to an exemplary embodiment of the present invention. Referring to FIG. 5, the gamma control or adjusting circuit 500 includes a first gray-scale voltage selection unit 510, a second gray-scale voltage selection unit 530, a third gray-scale voltage selection unit 550, and a gray-scale voltage generation unit 570.

The first resistor array 512 of the first gray-scale voltage selection unit 510 connects a first supply voltage VDD and a second supply voltage VSS to generate a plurality of first voltages.

The first voltage selector 514 selects one from among the generated first voltages as a highest gray-scale voltage V0 and a first reference voltage VREF1, in response to a first control signal C1. The first reference voltage VREF1 and the highest gray-scale voltage V0 indicate the same voltage.

The second voltage selector 516 selects one from among the generated first voltages as a lowest gray-scale voltage V63 and an eighth reference voltage VREF8, in response to a second control signal C2. The lowest gray-scale voltage V63 and the eighth reference voltage VREF8 indicate the same voltage but are referred to with different names according to the locations where they are applied.

The first and eighth reference voltages VREF1 and VREF8 are generated by the first gray-scale voltage selector 510 and then are used by another constituent element. Thus, they are respectively output via a first voltage follower 518 and a second voltage follower 520 for providing stable output of the voltages. A conventional gamma control circuit uses variable resistors to generate highest and lowest gray-scale voltages. In contrast, a gamma control circuit according to an exemplary embodiment of the present invention selects highest and lowest gray-scale voltages from among a plurality of voltages generated by an array of resistors without variable resistors that occupy an excessive amount of space, thereby significantly reducing the overall size of the gamma control circuit.

The second gray-scale voltage selection unit 530 includes a second resistor array 532, a third voltage selector 534, a fourth voltage selector 536, a third voltage follower 538, and a fourth voltage follower 540. The second resistor array 532 connects the first and eighth reference voltages VREF1 and VREF8 output from the first gray-scale voltage selection unit 510 to generate a plurality of second voltages. The third voltage selector 534 selects one of the plurality of second voltages in response to a third control signal C3 and outputs the selected one as a first intermediate voltage. The fourth voltage selector 536 selects one of the second voltages in response to a fourth control signal C4 and outputs the selected one as a second intermediate voltage.

Figure 3:
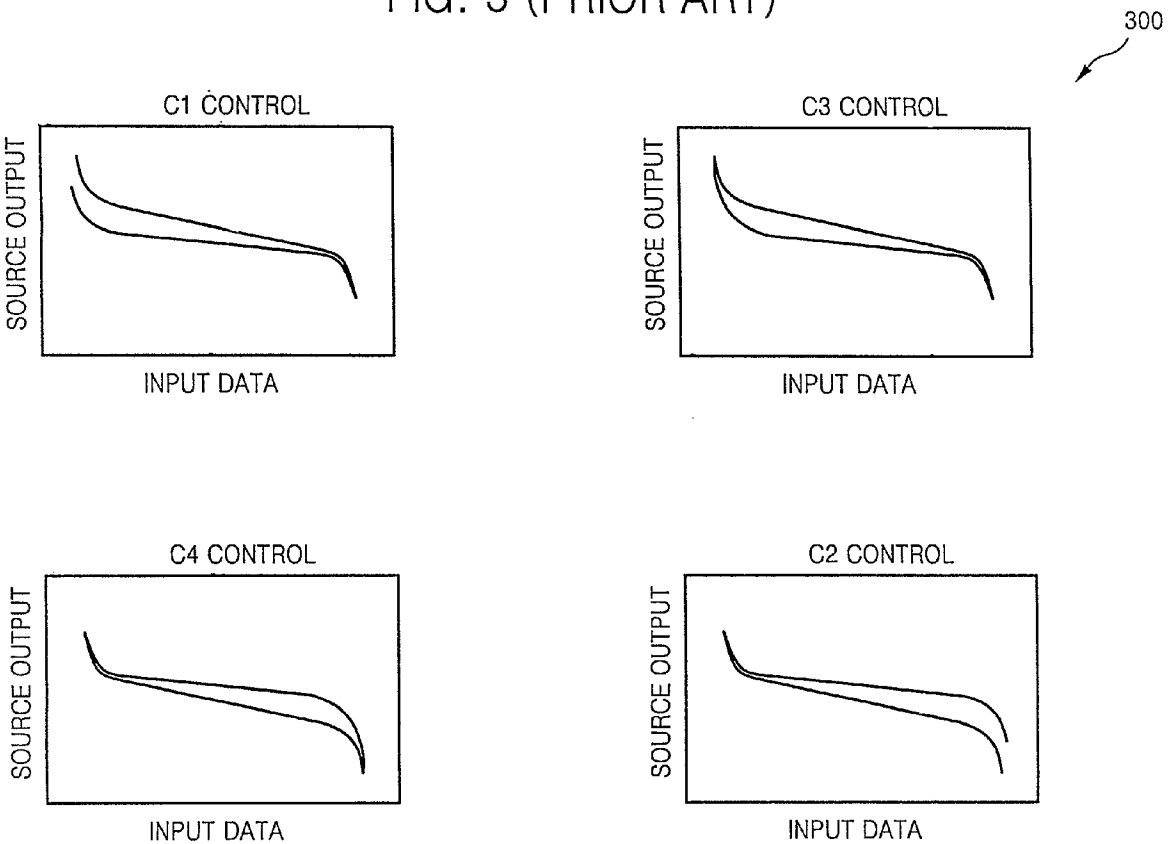
FIG. 3 (PRIOR ART)
FIG. 3 illustrates examples of gamma control performed by the conventional gamma control circuit of FIG. 2.
Figure 4:
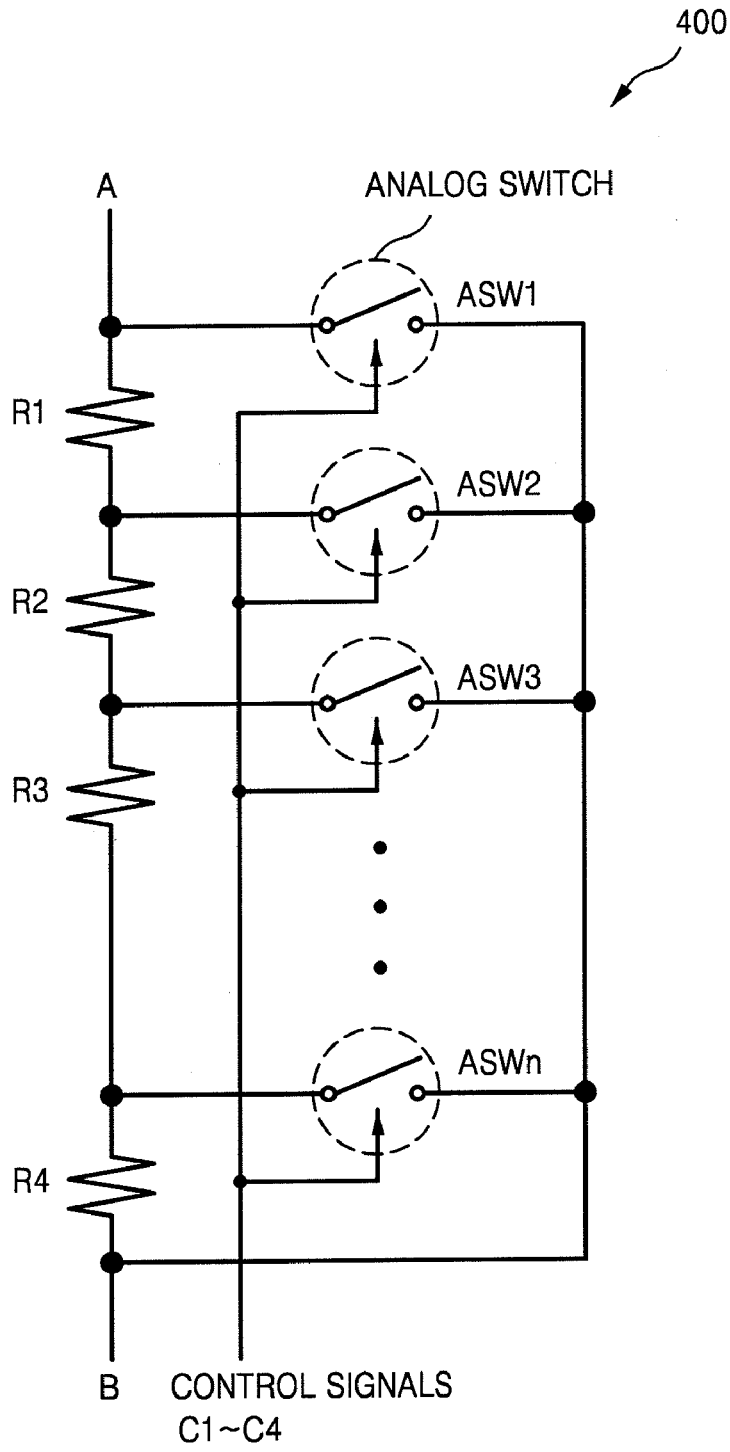
FIG. 4 (PRIOR ART)
FIG. 4 is a circuit diagram of a variable resistor such as that illustrated in FIG. 2.

The whole inclination or slope of a gamma curve is determined by the first and second intermediate voltages. As was illustrated in FIG. 3, the inclination of a gamma curve can be controlled with the first and second intermediate voltages when the range of the gray-scale voltages is uniform. The third and fourth voltage followers 538 and 540 stabilize output voltages, similarly to the first and second voltage followers 518 and 520.

A conventional gamma control circuit uses variable resistors to generate first and second intermediate voltages, whereas a gamma control circuit according to an exemplary embodiment of the present invention selects first and second intermediate voltages from among a plurality of voltages generated by a resistor array, thereby reducing the chip size.

The third gray-scale voltage selection unit 550 includes a third resistor array 552, a fourth resistor array 554, a fifth resistor array 556, a plurality of voltage selectors 558, and a plurality of voltage followers.

The third resistor array 552 connects the first reference voltage VREF1 and the first intermediate voltage output from the third voltage follower 538 to generate a plurality of third voltages. The fourth resistor array 554 connects the first intermediate voltage and the second intermediate voltage output from the fourth voltage follower 540 to generate a plurality of fourth voltages. The fifth resistor array 556 connects the second intermediate voltage and the eighth reference voltage VREF8 to generate a plurality of fifth voltages.

The voltage selectors 558 select and output second through seventh reference voltages VREF2 through VREF7 from among the plurality of third voltages, the plurality of fourth voltages, and the plurality of fifth voltages, in response to corresponding reference voltage control signals Q1 through Q6, respectively. The second through seventh reference voltages VREF2 through VREF7 may be output through a plurality of voltage followers for providing stable output voltages, respectively.

The gray-scale voltage generation unit 570 includes a resistor array, and receives the first through eighth reference voltages VREF1 through VREF8 and generates and outputs a plurality of gray-scale voltages V0 through V63.

Figure 6:
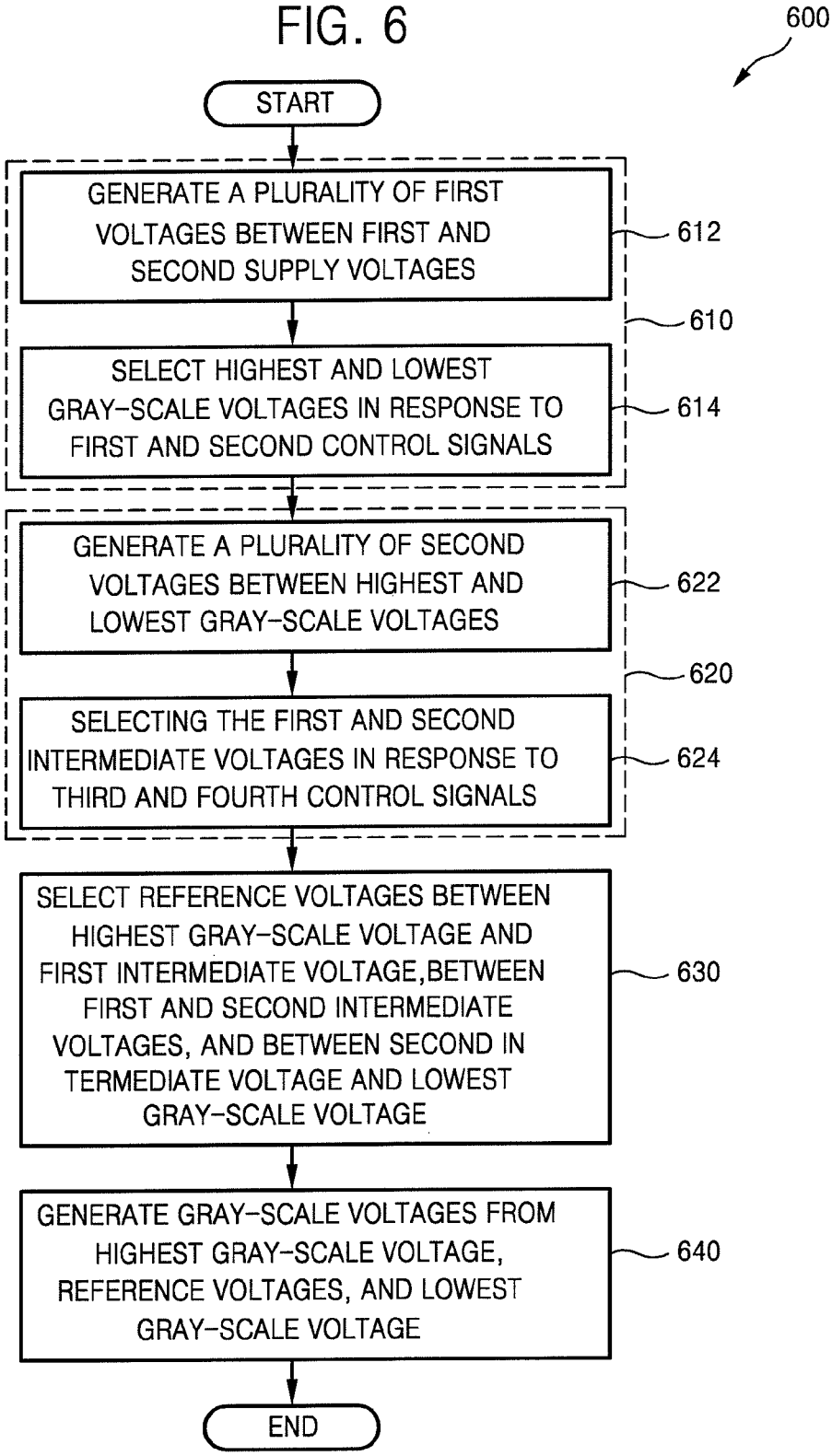
FIG. 6 is a flowchart illustrating a gamma control method performed by a gamma control circuit, according to an exemplary embodiment of the present invention.

FIG. 6 is a flowchart illustrating a gamma control method 600 performed by a gamma control circuit according to an exemplary embodiment of the present invention. Referring to FIG. 6, the gamma control method 600 performs gamma control by selecting highest and lowest gray-scale voltages from among a plurality of voltages.

The gamma control method 600 includes selecting a highest gray-scale voltage and a lowest gray-scale voltage from among a plurality of voltages between a first supply voltage and a second supply voltage (610), selecting a first intermediate voltage and a second intermediate voltage from among a plurality of second voltages between the highest and lowest gray-scale voltages (620), selecting reference voltages from among a plurality of voltages between the highest gray-scale voltage and the first intermediate voltage, between the first and second intermediate voltages, and between the second intermediate voltage and the lowest gray-scale voltage (630), and generating gray-scale voltages based on the highest gray-scale voltage, the reference voltages, and the lowest gray-scale voltage (640).

More specifically, operation 610 includes generating a plurality of first voltages by connecting a first supply voltage and a second supply voltage via a resistor array (612) and selecting the highest and lowest gray-scale voltages from among the plurality of first voltages in response to a first control signal and a second control signal (614). Operation 620 includes generating a plurality of second voltages by connecting the highest and lowest gray-scale voltages via a resistor array (622) and selecting the first and second intermediate voltages from the plurality of second voltages, in response to a third control signal and a fourth control signal (624).

As described above, in a gamma control circuit and method thereof according to an exemplary embodiment of the present invention, a highest gray-scale voltage and a lowest gray-scale voltage are selected from among a plurality of voltages, and thus, various gray-scale voltages can be provided with a small-sized gamma control circuit.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A gamma control circuit comprising:

a first gray-scale voltage selection unit for selecting and outputting a highest gray-scale voltage and a lowest gray-scale voltage from among a plurality of first voltages present between a first supply voltage and a second supply voltage;

a second gray-scale voltage selection unit receiving the highest and the lowest gray-scale voltages, and selecting and outputting a first intermediate voltage and a second intermediate voltage from among a plurality of second voltages present between the highest and the lowest gray-scale voltages;

a third gray-scale voltage selection unit receiving the highest and the lowest gray-scale voltages and receiving the first and second intermediate voltages, and generating a plurality of reference voltages based on the received voltages; and a gray-scale voltage generation unit receiving the highest and lowest gray-scale voltages and receiving the plurality of reference voltages, and outputting a plurality of gray-scale voltages based on the received voltages, wherein the selecting from among the plurality of first voltages and the selecting from among the plurality of second voltages are from respective resistor arrays without adjusting an amount of resistors of the respective resistor arrays to be connected by switching switches coupled to the resistors on/off.

* * * * *